United States Patent [19]

Aronie et al.

[11] Patent Number: 5,058,781

[45] Date of Patent: Oct. 22, 1991

[54] CAULKING GUN WITH DRIVE MEANS WHICH FACILITATE THE IMMEDIATE RELEASE OF PRESSURE FROM THE PISTON

[76] Inventors: Alan B. Aronie, 27 Seymour St., Concord, Mass. 01742; Joel Aronie, 175 N. Main St., West Hartford, Conn. 06107

[21] Appl. No.: 604,928

[22] Filed: Oct. 29, 1990

[51] Int. Cl.[5] ..... B67D 5/46

[52] U.S. Cl. ..... 222/326; 222/333; 222/390; 74/501.5 R; 74/502

[58] Field of Search ..... 222/326, 327, 333, 390; 411/55, 60, 271, 325; 74/501.5, 502; 192/111 A

[56] References Cited

U.S. PATENT DOCUMENTS

| | | | |
|---|---|---|---|
| 3,913,799 | 10/1975 | Davis, Jr. | 222/326 |
| 3,997,084 | 12/1976 | Davis Jr. | 222/326 |
| 4,024,994 | 5/1977 | Davis Jr. | 222/326 |
| 4,180,187 | 12/1979 | Ben-Haim | 222/326 |
| 4,260,076 | 4/1981 | Bergman | 222/327 X |
| 4,273,269 | 6/1981 | Davis Jr. | 222/326 |
| 4,304,322 | 12/1981 | Beccaris | 192/111 A |
| 4,306,671 | 12/1981 | Fisher | 222/326 |
| 4,322,022 | 3/1982 | Bergman | 222/327 |
| 4,344,518 | 8/1982 | Gilmore | 192/111 A |
| 4,598,809 | 7/1986 | Glover et al. | 192/111 A |
| 4,826,053 | 5/1989 | Keller | 222/326 X |

FOREIGN PATENT DOCUMENTS

| | | | |
|---|---|---|---|
| 0676605 | 2/1930 | France | 411/271 |
| 0101778 | 10/1916 | United Kingdom | 411/271 |

*Primary Examiner*—Michael S. Huppert
*Assistant Examiner*—Anthoula Pomrening
*Attorney, Agent, or Firm*—Henry D. Fahl, Jr.

[57] ABSTRACT

In the caulking gun disclosed herein, the piston of a caulking cartridge is driven by axial movement of a exteriorly threaded tube which is, in turn, driven by a rotating ring gear which is interiorly threaded to mate with the tube. The threaded tube is longitudinally split so that it can collapse out of engagement with the threads on the ring gear. A tapered plug cooperates with an expandable bushing inside the tube so as to hold the tube in engagement with the threads in the ring gear when the plug is in a first postion but, when the plug is moved to a second position, the bushing allows the tube to collapse thereby releasing pressure from the piston and allowing quick retraction of the split tube to facilitate loading of a new caulking cartridge.

10 Claims, 4 Drawing Sheets

CAULKING GUN WITH DRIVE MEANS WHICH FACILITATE THE IMMEDIATE RELEASE OF PRESSURE FROM THE PISTON

BACKGROUND OF THE INVENTION

The present invention relates to a powered caulking gun and more particularly to a novel system for driving a piston which facilitates immediate release of pressure from the piston when it is desired to stop the flow of caulking material.

While various powered caulking guns have been devised or proposed heretofore, these prior art systems have not generally provided an efficient mechanism for immediately releasing pressure when it is desired to terminate the flow of caulking material. Examples of these prior art systems are shown in U.S. Pat. Nos. 3,913,799; 3,997,084; 4,024,994; 4,180,187; 4,306,671; and 4,322,022. Likewise, Sears, Roebuck & Co. is currently offering a powered caulking gun as its model number 25600.

Among the several objects of the present invention may be noted the provision of a caulking gun employing a novel piston-driving mechanism; the provision of such a caulking gun which allows an operator to quickly and easily release pressure from a piston when it is desired to terminate the flow of caulking material; the provision of such a gun which is easily operated; the provision of such a gun which is easily loaded; the provision of such a gun which is highly reliable and which is of relatively simple and inexpensive construction. Other objects and features will be in part apparent and in part pointed out hereinafter.

SUMMARY OF THE INVENTION

The caulking gun of the present invention incorporates an apparatus for driving a piston thereby to expel caulking material in a controllable manner. A ring gear having an interiorly threaded central aperture is mounted for rotation within a housing together with means for rotating the ring gear. A tube which is exteriorly threaded to mate with the central aperture is longitudinally split so as to permit collapse of the tube out of engagement with the threads in the ring gear. A laterally expandable bushing is axially maintained relative to the housing within the tube in alignment with the ring gear and a plug which is axially movable between the first and second positions cooperates with the bushing in the first position to expand it to maintain the tube in engagement with the threaded aperture and, in the second position, allows the tube to collapse. A means, such as a manual lever, enables the operator of the caulking gun to move the plug between the first and second positions so that rotation of the ring gear effects the expelling of caulking material when the plug is in its first position and the movement of the plug to its second position releases pressure from the piston.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
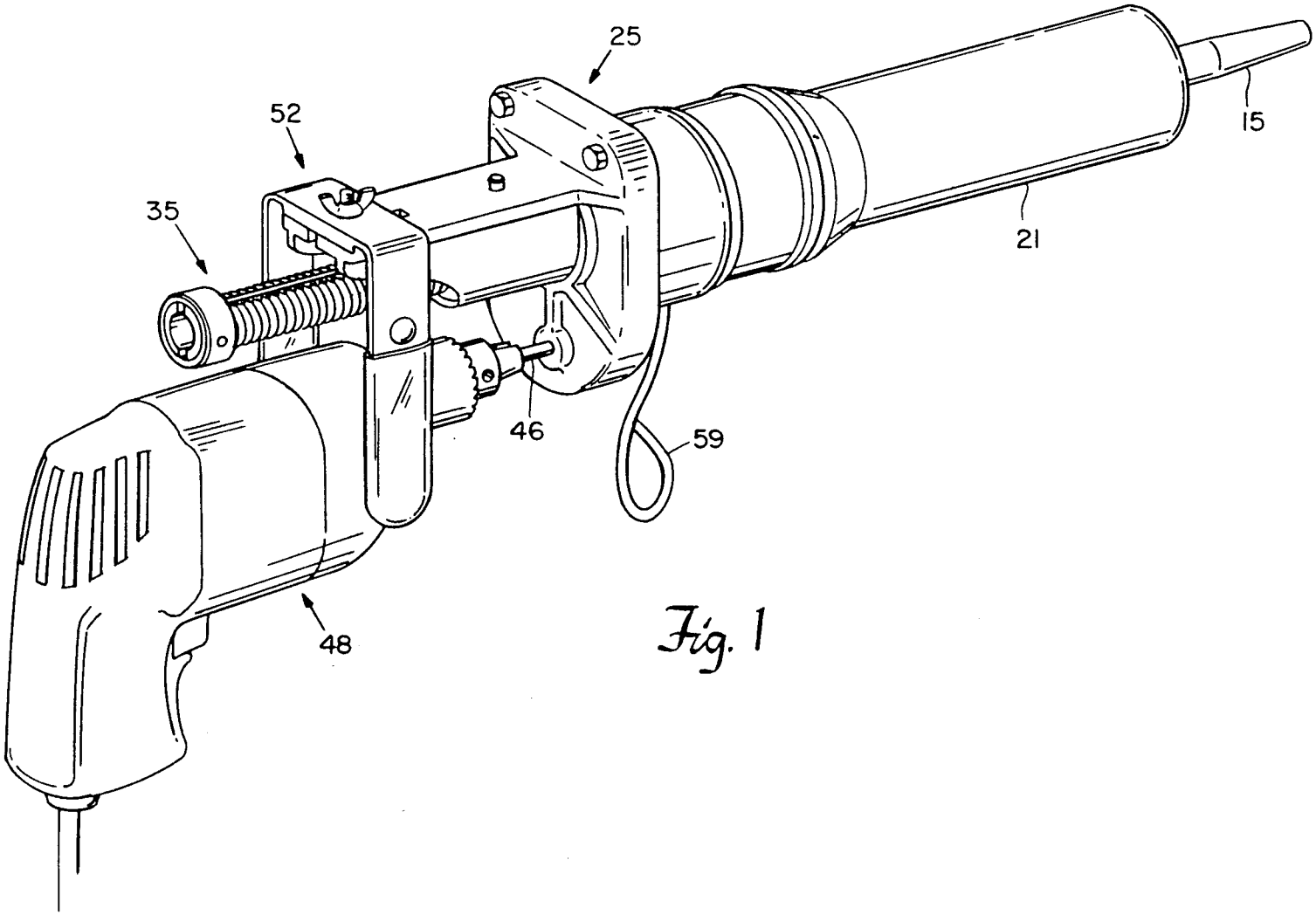
FIG. 1 is a perspective view of a caulking gun constructed in accordance with the present invention, together with an electric drill for powering the caulking gun.
Figure 2:
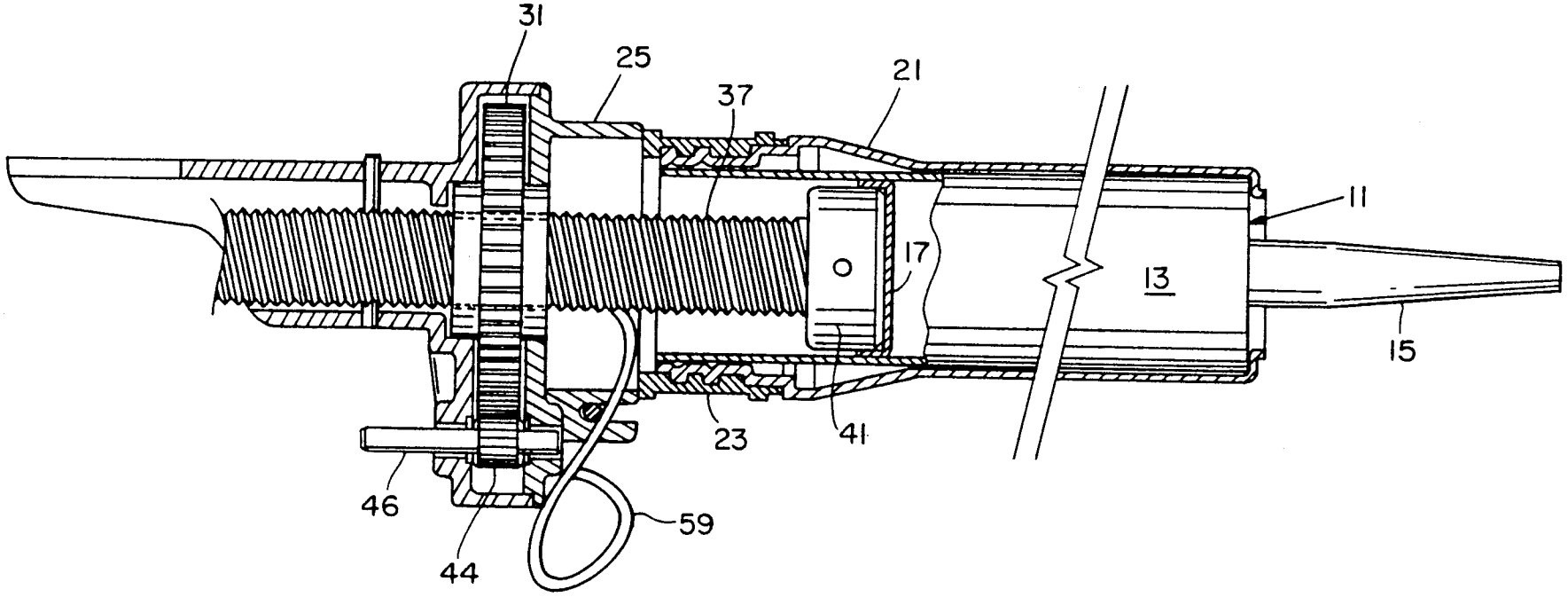
FIG. 2 is a side view, with some parts broken away, of the caulking gun of FIG. 1.

The apparatus described herein is adapted to use conventional caulking gun cartridges, such a cartridge being indicated generally by reference character 11 in FIGS. 1 and 2. The cartridge 11 comprises a tubular body 13, a spout 15 and a built-in piston 17 which, when driven axially, ejects caulking material from the cartridge through the spout.

The cartridge 11 is held within a tubular sleeve or barrel 21. Barrel 21 threads into a mating socket 23 which is attached to a housing 25 which contains the driving components of the gun. The housing 25 is conveniently assembled from injection molded sub-components bolted together into a unitary structure.

Journaled within the housing 25 is a ring gear 31. Ring gear 31 incorporates a central aperture which is interiorly threaded as indicated by reference character 33 in FIGS. 3 and 4. Passing through the aperture in the ring gear is a plunger structure 35 which operates to drive the caulking cartridge piston 17. The plunger structure 35 incorporates a tubular element, designated generally by reference character 37, which is provided with exterior threads 39 which correspond with and can mate with the interior threads 33 on the ring gear 31. The tubular element is also preferably constructed of a suitable plastic which provides appropriate resiliency or compliance as described hereinafter.

The ring gear 31 may be rotated by means of a pinion gear 44 mounted on a shaft 46 journaled in the housing 25 below the ring gear. The pinion gear, in turn, may be driven by a suitable power source such as an electric or cordless drill as indicated generally by reference character 48. Uncontrolled movement of the drill or other power source relative to the caulking gun proper is constrained by means of a clamp structure indicated generally by reference character 52.

While the exterior threads 39 on the tubular element can mate with the ring gear interior threads 33, the tubular element itself is longitudinally split so as to permit the tube to collapse out of engagement with the ring gear threads. In the embodiment illustrated, the tubular element 37 is longitudinally split at both the top and the bottom so as to, in effect, comprise two separable halves. It should be understood, however, that a single longitudinal split might also be utilized. In the embodiment illustrated, the two halves of the the threaded tubular element 37 are linked at each end by a ring 41 carrying a transverse pin 43 which extends through the two halves of the tube. The ring may be omitted at the end opposite the piston.

A laterally expandable bushing or sleeve 51 is provided within the tubular element 37. Axial positioning of the bushing 51 relative to the ring gear 31 is maintained by two pins 53 and 54 which extend from the housing into the left end of the bushing through the slots which separate the two halves of the tubular member. A tapered plug 55 cooperates with the bushing 51 to control its lateral expansion.

Figure 3:
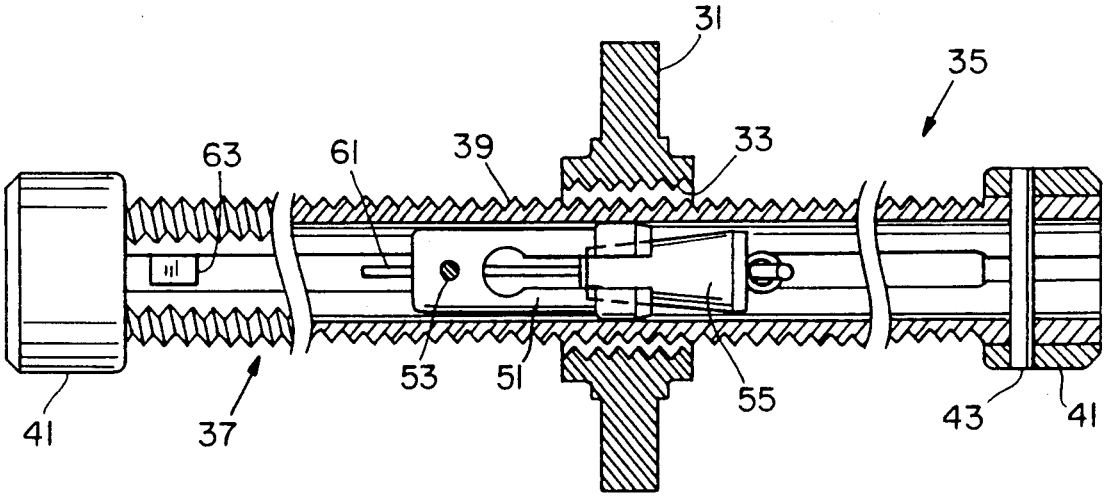
FIGS. 3 and 4 are, respectively, top and side views in section showing the driving components of the caulking gun out of engagement.
Figure 4:
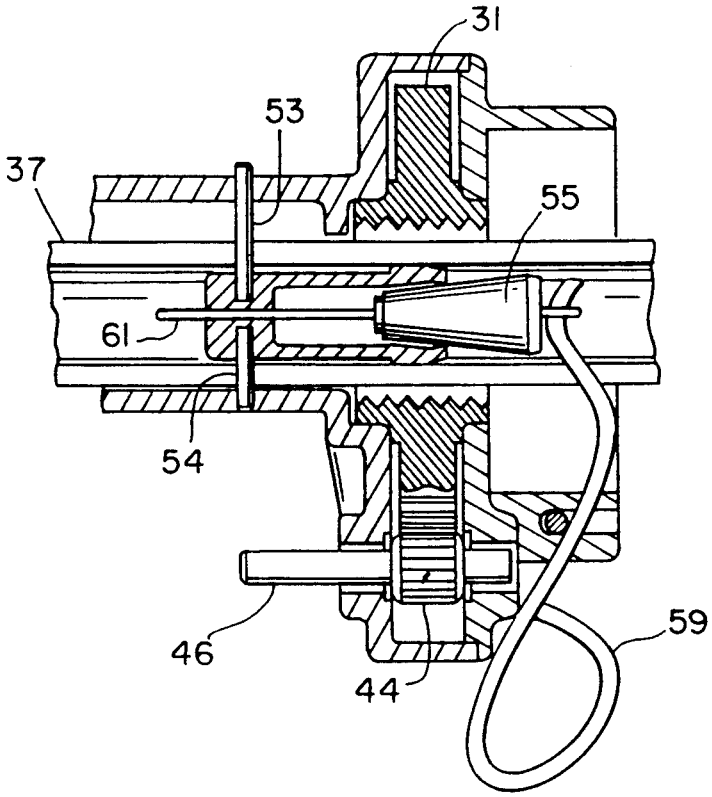
Figure 5:
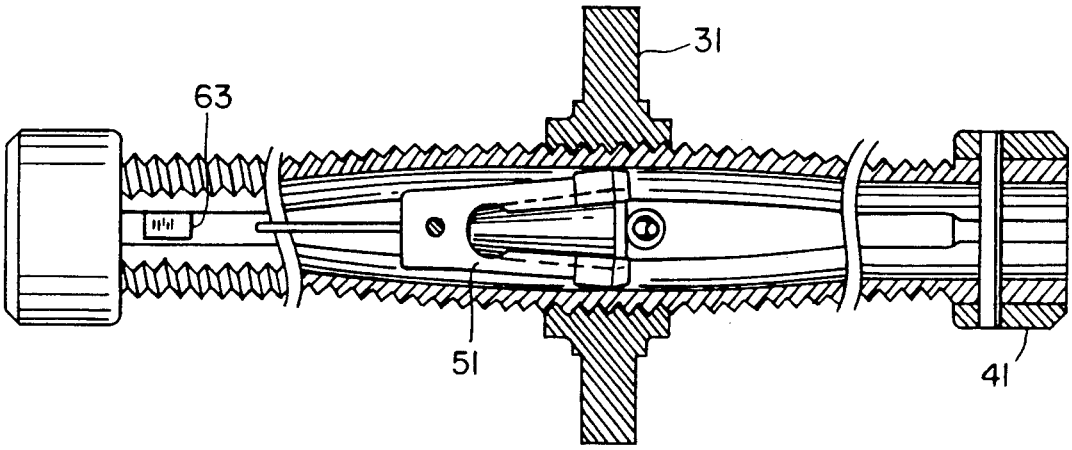
FIGS. 5 and 6 are, respectively, top and side views in section showing the driving components in engaged condition.
Figure 6:
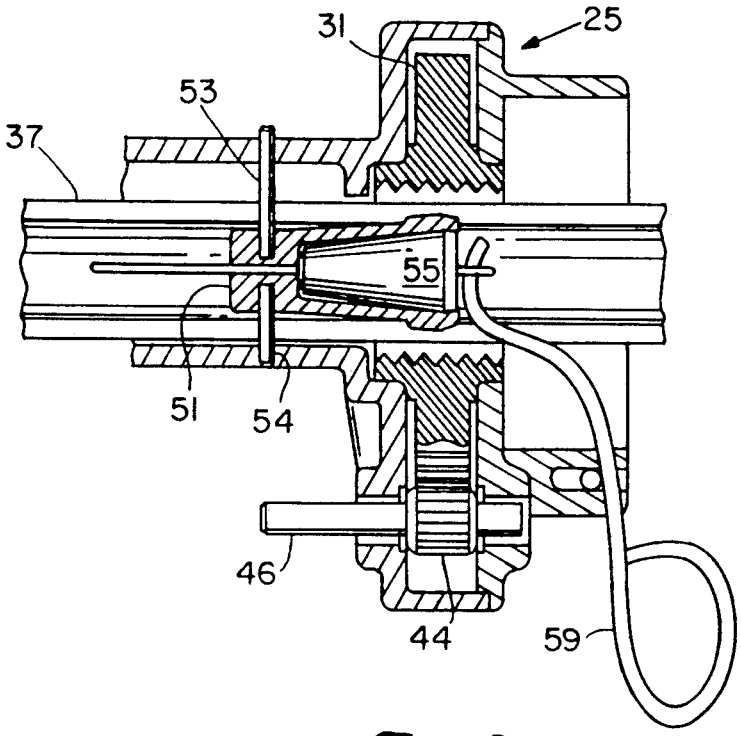

By means of a pivoted lever 59, the operator of the caulking gun can move the plug 55 between a first position, shown in FIGS. 5 and 6 and a second position, shown in FIGS. 3 and 4. In the first position, the plug is driven into and expands the bushing 51 and in the second position the plug is withdrawn from the bushing so that the bushing is in its non-expanded state. The plug-receiving socket in the bushing 51 preferably incorporates a slight reverse taper or lip at the opening of the socket so that the plug will be retained when inserted.

When the plug is in its first or left hand position as illustrated in FIGS. 5 and 6, the two halves of the tubular . element 37 are held apart so that the exterior threads on the tubular element are held in engagement with the interior threads on the ring gear 31. Accordingly, rotation of the ring gear will produce a corresponding axial movement of the tubular element, e.g. to the right as shown in the drawings. This axial movement can be transmitted, through the right hand end ring 41, to the caulking cartridge piston 17 for ejecting caulking material through the spout 15. On the other hand, by moving the plug to its second or right hand position, the operator of the caulking gun can allow the tubular element 37 to collapse so that its exterior threads can come out of engagement with the interior threads on the ring gear 31. Accordingly, axial force will be immediately released from the piston 15, thereby releasing pressure from within the cartridge 11 and thus terminating the flow of caulking material from the spout 15.

As is well understood by those skilled in the art, merely stopping the driving force to the piston of a caulking gun cartridge will not ordinarily immediately terminate the flow o caulking material since, due to the inherent resilience of the various components, there is stored energy by virtue of the pressurizing of the cartridge. Further, the tubular element can be easily grasped and withdrawn so as to facilitate the insertion of a new caulking cartridge.

To prevent overdriving of the piston, the apparatus illustrated includes a means for automatically releasing the driving force when the threaded element 37 reaches the desired end of its stroke. A headed pin 61 extends from the plug receiving socket of the bushing 51 to a point to the left of the bushing through a corresponding central aperture. A block or lug 63 is provided on one of the halves of the threaded tubular element 37 near its left hand end. When the threaded element 37 has moved its full desired travel to the right, the lug 63 engages the pin 61 which, in turn, pushes the tapered plug 55 out of the bushing 51 and thereby releases the driving pressure.

In view of the foregoing it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. In a caulking gun, an apparatus for driving a piston thereby to expel caulking material in a controllable manner, said apparatus comprising:

a housing;

in said housing, a ring gear having a central aperture which is interiorly threaded;

means for rotating said ring gear;

a tube which is exteriorly threaded to mate with the central aperture of said ring gear and is longitudinally split so as to permit collapse of the tube out of engagement with the central aperture of said ring gear, one end of said tube being adapted to engage a piston for driving the piston in response to axial movement of the tube;

a laterally expandable bushing which is within said tube and is maintained in axial position relative said housing in alignment with said ring gear;

a plug which is axially movable relative to said bushing between first and second positions and which, in said first position, cooperates with said bushing to expand the bushing to maintain said tube in engagement with the threaded aperture in said ring gear and, in said second position, allows said tube to collapse; and means enabling the operator of the caulking gun to move said plug between said first and second positions whereby rotation of said ring gear effects expelling of caulking material when said plug is in said first position and movement of said plug to said second position releases pressure from the piston.

2. Apparatus as set forth in claim 1 wherein said tube is axially split at two points thereby to form two opposed portions.

3. Apparatus as set forth in claim 2 including means at one end of said tube for linking said two portions for axial movement together.

4. Apparatus as set forth in claim 1 wherein said means for rotating said ring gear includes a pinion gear mounted on a shaft which extends exteriorly of said housing.

5. Apparatus as set forth in claim 4 including means on said housing for holding motor means for driving said shaft.

6. Apparatus as set forth in claim 1 wherein said plug is tapered and fits within a socket in said bushing for expanding said bushing in response to axial relative movement.

7. Apparatus as set forth in claim 1 wherein the means for moving said plug comprises a manually operable lever which extends into said tube through the axial split therein.

8. In a caulking gun, an apparatus for driving a piston thereby to expel caulking material in a controllable manner, said apparatus comprising:

a housing;

in said housing, a ring gear having a central aperture which is interiorly threaded;

means for rotating said ring gear;

a tube which is exteriorly threaded to mate with the central aperture of said ring gear and is longitudinally split so as to permit collapse of the tube out of engagement with the central aperture of said ring gear, one end of said tube being adapted to engage a piston for driving the piston in response to axial movement of the tube, the other end of the tube projecting exteriorly of said housing;

a laterally expandable bushing which is within said tube and is maintained in axial position relative said housing in alignment with said ring gear;

a plug which is axially movable relative to said bushing between first and second positions and which, in said first position, cooperates with said bushing to expand the bushing to maintain said tube in engagement with the threaded aperture in said ring gear and, in said second position, allows said tube to collapse; and means enabling the operator of the caulking gun to move said plug between said first and second positions whereby rotation of said ring gear drives said tube axially to effect expelling of caulking material when said plug is in said first position and movement of said plug to said second position releases said tube and allows it to be withdrawn to facilitate insertion of a new caulking cartridge.

9. Apparatus as set forth in claim 8 wherein said tube carries means for moving said plug to its second position when said tube reaches a predetermined point in its travel.

10. In a caulking gun, an apparatus for driving a piston thereby to expel caulking material in a controllable manner, said apparatus comprising:

a housing;

journaled in said housing, a ring gear having a central aperture which is interiorly threaded;

journaled in said housing, a pinion gear coupled to said ring gear;

a shaft for driving said pinion gear;

a tube which is exteriorly threaded to mate with the central aperture of said ring gear and is longitudinally split into two opposed portions so as to permit collapse of the tube out of engagement with the central aperture of said ring gear, means at one end of said tube for linking said opposed portions and for engaging a piston for driving the piston in response to axial movement of the tube;

a laterally expandable bushing which is within said tube and is maintained in axial position relative said housing in alignment with said ring gear, said bushing including a tapered socket;

a tapered plug which is axially movable relative to said bushing between first and second positions and which, in said first position, cooperates with said socket to expand the bushing to maintain said tube in engagement with the threaded aperture in said ring gear and, in said second position, allows said tube to collapse; and lever means extending between said opposed tube portions for enabling the operator of the caulking gun to move said plug between said first and second positions whereby rotation of said ring gear effects expelling of caulking material when said plug is in said first position and movement of said plug to said second position releases pressure from the piston.

* * * * *